US007070135B2

(12) United States Patent
Pallmann

(10) Patent No.: US 7,070,135 B2
(45) Date of Patent: Jul. 4, 2006

(54) CHIPPING APPARATUS WITH ECCENTRIC CHIPPING TOOLS

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 139 days.

(21) Appl. No.: 10/452,592

(22) Filed: Jun. 3, 2003

(65) Prior Publication Data

US 2003/0226921 A1 Dec. 11, 2003

(30) Foreign Application Priority Data

Jun. 3, 2002 (DE) ..... 202 08 605 U

(51) Int. Cl.
*B02C 23/02* (2006.01)

(52) U.S. Cl. ..... 241/248; 241/252; 241/254; 241/261.2; 241/261.3

(58) Field of Classification Search ..... 241/248, 241/252, 254, 261.2, 261.3
See application file for complete search history.

(56) References Cited

U.S. PATENT DOCUMENTS 2,139,933 A * 12/1938 Chenoweth ..... 241/38
2,239,497 A 4/1941 Byers et al.
3,392,923 A * 7/1968 Reinecker et al. ..... 241/56
3,416,740 A * 12/1968 Hodgson et al. ..... 241/21
4,175,814 A * 11/1979 Ozasa et al. ..... 241/46.01
4,372,495 A * 2/1983 Marton et al. ..... 241/28
4,954,221 A * 9/1990 Reinhall et al. ..... 162/261
5,011,091 A * 4/1991 Kopecky ..... 241/259.1
5,279,463 A 1/1994 Holl

FOREIGN PATENT DOCUMENTS

DE 922 627 12/1954
DE 693 26 897 T2 12/2000

* cited by examiner

*Primary Examiner*—Derris H. Banks
*Assistant Examiner*—Jason Y. Pahng
(74) *Attorney, Agent, or Firm*—Birch Stewart Kolasch & Birch, LLP

(57) ABSTRACT

A chipping apparatus includes a housing arranged about an axis of rotation and a chipping system within the housing rotating in a predefined direction about an axis of rotation. The chipping system has chipping tools that form a circular or ring-shaped chipping zone. The housing is divided into the sectors I, II, III and IV in the direction of rotation, with a material outlet being arranged in sector I. The axis of rotation of the chipping system is arranged eccentrically, with respect to a central axis of the housing, in the region of sector I or II. In this way, a uniformly widening flow channel is produced between the chipping tools and the housing, even when the housing is circular in cross-section. The constant volume increase in the flow channel toward the material outlet prevents an increasing material density, which can cause blockages in the material flow.

13 Claims, 4 Drawing Sheets

CHIPPING APPARATUS WITH ECCENTRIC CHIPPING TOOLS

This nonprovisional application claims priority under 35 U.S.C. § 119(a) on German Patent Application No. 202 08 605.4, filed in Germany on Jun. 3, 2002, which is herein incorporated by reference.

BACKGROUND OF THE INVENTION

1. Field of the Invention

The present invention relates to a chipping apparatus with eccentric chipping tools.

2. Description of the Background Art

Chipping apparatuses are known, for example, from DE 922 627. These apparatuses receive material for chipping axially and, after redirecting it in a radial direction, deliver it to chipping tools, which are arranged in a ring about an axis of rotation. After chipping, the chipped material radially enters an approximately ring-shaped channel formed by the circumference of the housing and the chipping tools, which ultimately terminates in a tangentially arranged material outlet and to which are connected additional pipes for removing the chipped material. As a result of the air current present in the channel, the chipped material, which is leaving the chipping zone over the entire circumference of the chipping tool, is carried along by the air current and transported toward an outlet.

Because cumulative effects cause the density of chipped material to increase toward the material outlet, conventional chipping apparatuses have a spiral-shaped housing circumference, wherein the axis of rotation of the chipping tools is located at the starting point of the spiral and the housing circumference becomes progressively larger in the direction of rotation. Thus, the channel cross-section continuously increases toward the material outlet so that a continuously growing channel volume is available for the chipped material moving toward the outlet. This achieves the result that the density of chipped material remains approximately constant over the entire length of the channel or even decreases, whereby the objective hereof is to avoid blockage in the material flow.

The price paid for obtaining this objective, however, is resource-intensive manufacture of the machine housing. Because of the spiral shape of the housing circumference, the individual parts of the housing must be specially traced out, cut out, and fitted together. The deviation from standardized shapes such as rectangles and circles is thus associated with a high amount of manual work, which results in higher manufacturing costs for prior art chipping apparatuses.

SUMMARY OF THE INVENTION

It is therefore an object of the present invention to simplify the design of a chipping apparatus without impeding unobstructed material flow within the apparatus.

The invention uses a channel that widens toward a material outlet to counteract an increase in the density of chipped material and the associated risk of material blockage. However, the invention departs from the concept ubiquitous in conventional devices, which is to arrange the axis of rotation of the rotating chipping tools in a center or starting point of the housing and continuously increasing the distance between the chipping tools and the housing circumference in order to enlarge the spatial volume closer to the material outlet.

Instead, in accordance with the invention, an axis of rotation is arranged eccentric to the housing in such a manner that the chipping tools approach the housing circumference in one region, while being spaced further away in the opposite region. The region of approach concerns a section of the housing circumference that follows the material outlet in the direction of rotation. This is possible since a relatively low density of chipped material is present here as compared to subsequent regions.

The advantage of this arrangement of the axis of rotation is particularly evident for an embodiment of a housing having a circular circumference. Thus, in a circular housing, a channel that widens toward the outlet is created by the eccentric arrangement of the chipping tools. Such a circular housing is relatively simple to manufacture because it is largely defined only by a radius and a housing depth.

This, however, does not mean that the invention does not extend to spiral-shaped housings, since the inventive effect of steady volume increase of the channel also occurs to involute, e.g., spiral-shaped housings, thereby a cumulative effect together with the volume increase is achieved resulting from the spiral shape of the housing.

In a further embodiment of the invention, the axis of rotation is arranged in a region about an angle bisector of sector II of ±15°, preferably ±10°. In this way, a housing that expands in a spiral shape is simulated to the greatest degree possible with the resultant advantages.

Another embodiment of the invention provides that the eccentricity with respect to the $X_1$ axis is chosen larger than the eccentricity with respect to the $Y_1$ axis. This is advantageous especially for material that is particularly prone to clogging the channel near the outlet.

The amount of eccentricity should not be chosen too large, in order not to cause stoppage of the material flow in the narrowest region between the housing and the chipping zone. For this reason, an advantageous embodiment of the invention limits the eccentricity to a maximum of one fifth of the housing radius.

The determining factor for a constant material density in the chipping apparatus is the relationship between the shortest distance from the chipping zone to the housing and the greatest distance from the chipping zone to the housing. A preferred embodiment of the invention provides that the shortest distance to the housing circumference is specified as at least one fifth of the greatest distance. Preferably, the shorter distance to the housing should be chosen approximately half as large as the larger distance.

In a preferred embodiment of the invention, the housing is manufactured as a single piece, wherein the transition regions between the circumferential surface and the front and rear walls of the housing are round. This avoids sharp corners, which tend to constitute sticking points for the chipped material, and which therefore tend to be the starting points for blockages in the material flow. This embodiment thus acts to support a trouble-free flow of material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
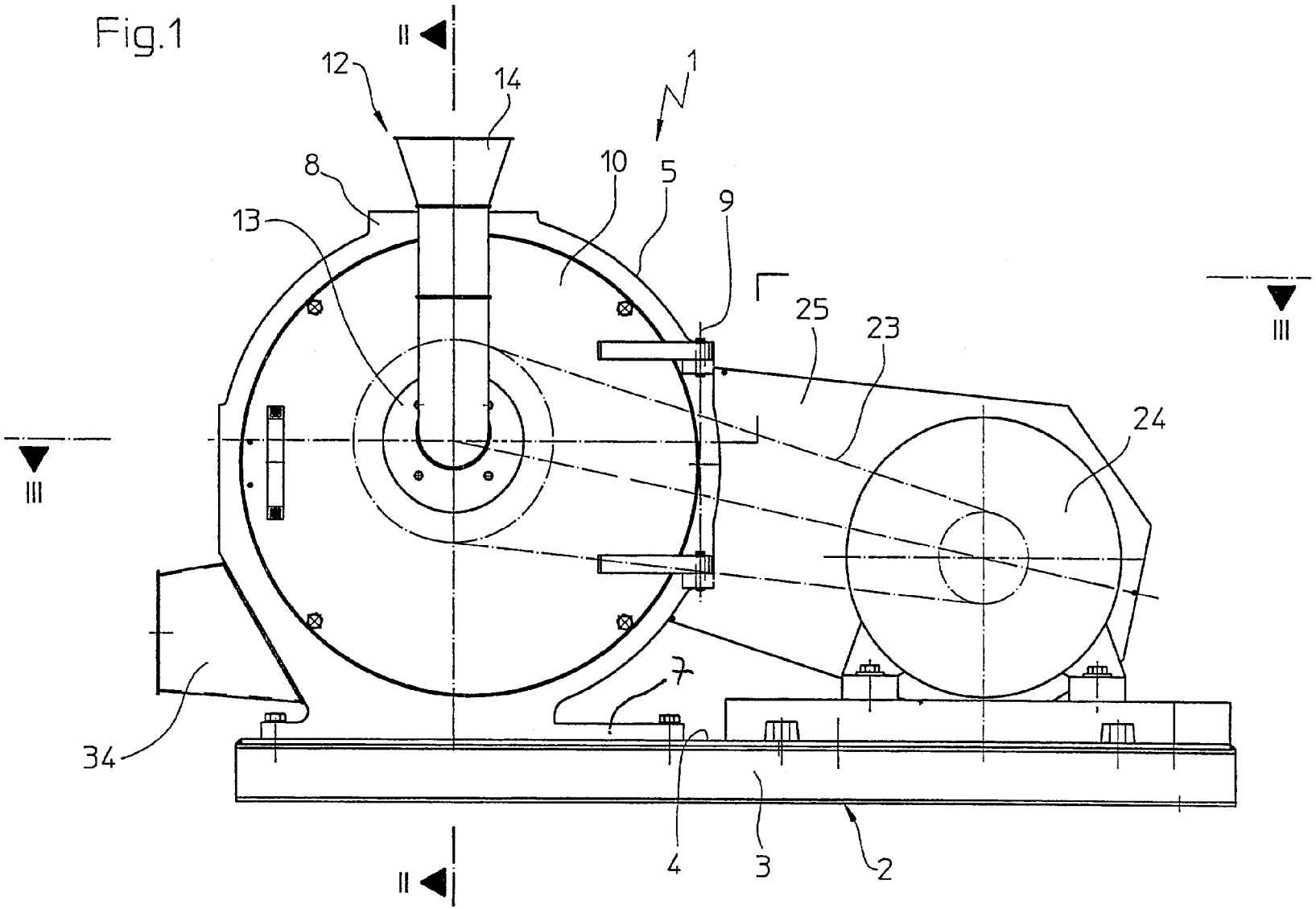
FIG. 1 is a front view of an apparatus in accordance with a preferred embodiment of the invention.
Figure 2:
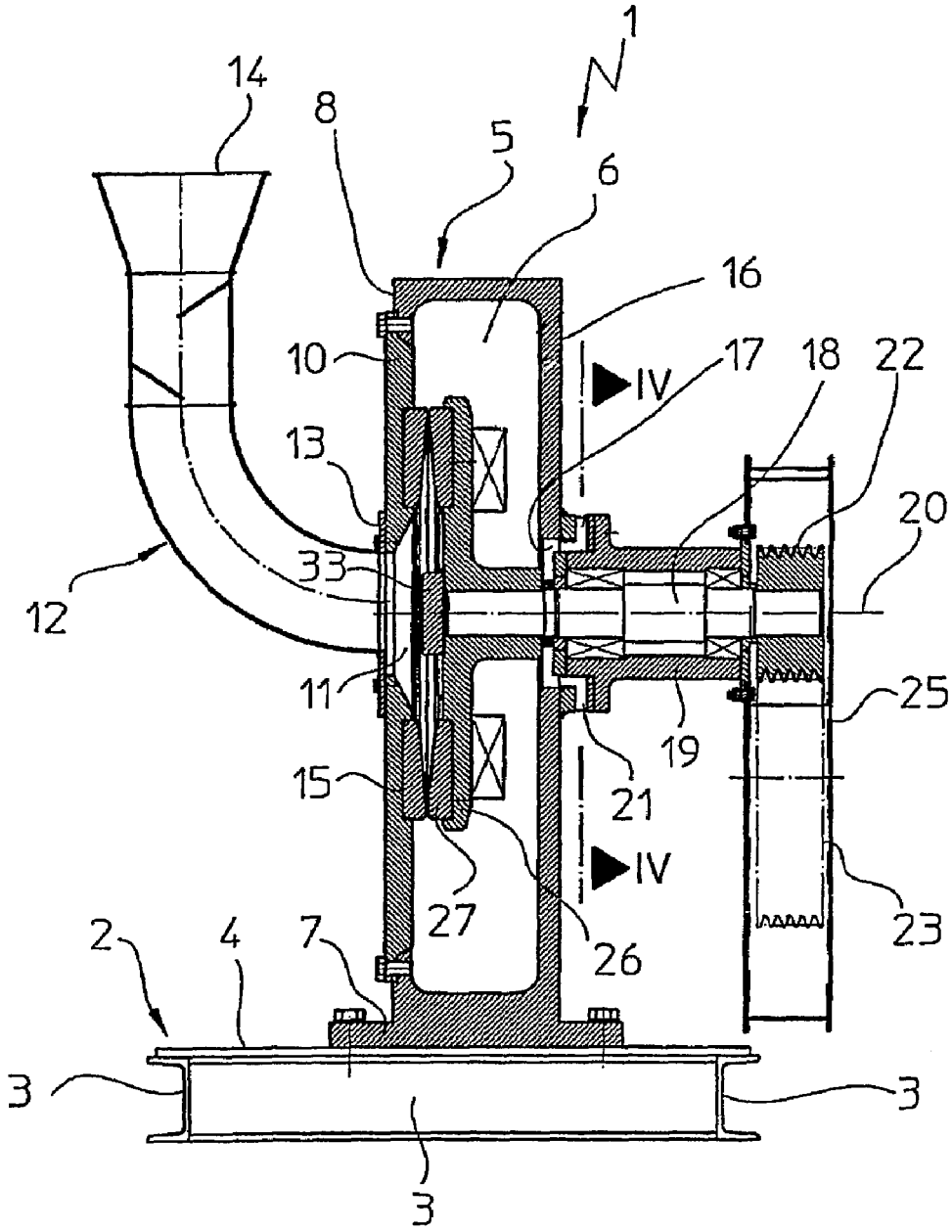
FIG. 2 is a vertical sectional view of the apparatus shown in FIG. 1 along the line II—II.
Figure 3:
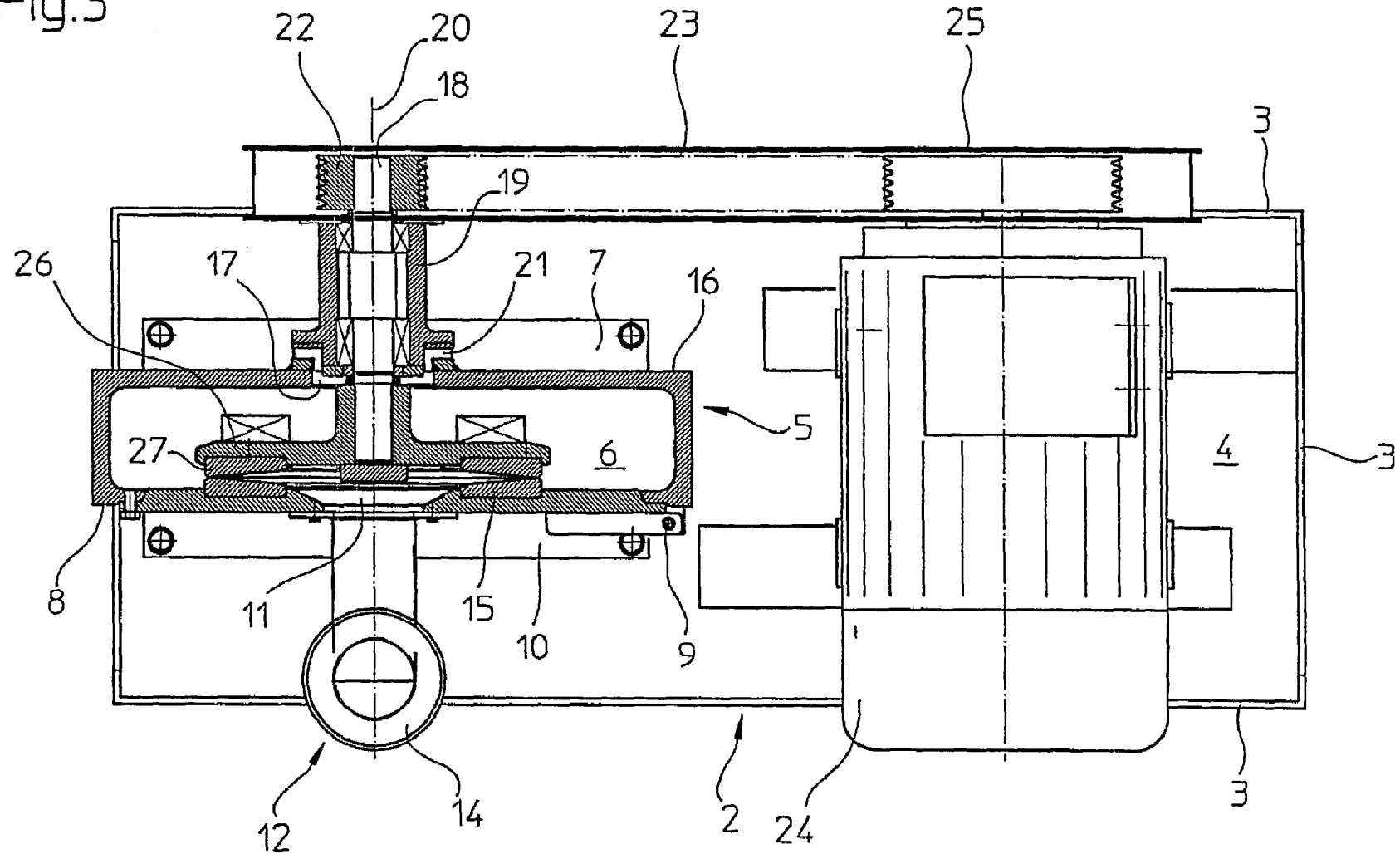
FIG. 3 is a horizontal sectional view of the apparatus shown in FIG. 1 along the line III—III.

A chipping apparatus, such as a disk mill 1, in accordance with the invention is shown in FIGS. 1–3. Shown in FIGS. 1–3 is a substructure 2 having a peripheral frame profile 3 with a top cover 4 and thus constitutes a platform for the remaining structure of the machine.

The disk mill 1 has a drum-shaped housing 5 that encloses a disk-shaped chipping chamber 6. The housing 5 is rigidly affixed to the cover 4 through a mill base 7, by, for example, screws. Located in the base area of the housing 5 is a lateral material outlet 34, which opens tangentially onto the chipping chamber 6. The front wall 8 of the housing 5 has a centered circular opening, which can be closed by a housing door 10 that pivots about an axis 9 and can be locked.

The housing door 10 likewise has a circular opening 11 through which an axial passage of the feed material is possible. The opening 11 expands sharply in a conical shape over the thickness of the housing door 10 from the outside to the inside, so that the inner edge of the opening 11 has a larger diameter than the outer edge.

On the outside, the opening 11 adjoins a fall shaft 12 whose end facing the mill is fastened to the housing door 10 with the aid of a flange 13. The opposite end is provided with an inlet funnel 14 through which the feed material is supplied to the disk mill 1.

Adjoined to the inner edge of the opening 11 is a first tool ring 15 that is concentric to the opening 11 and is rigidly affixed, for example, by screws, to the inner side of the housing door 10, whose active surface is grooved.

A rear wall 16 of the housing 5 has a circular opening 17 that is opposite the opening 11 and through which extends the front end of a horizontal drive shaft 18. The drive shaft 18 is supported so as to be freely rotatable about an axis of rotation 20 within a shaft bearing 19. The shaft bearing 19 is rigidly connected to the rear wall 16 of the housing 5 with an interposed ring bearing 21 arranged coaxial to the axis of rotation 20.

Located on the back end of the drive shaft 18 outside the housing 5 is a multiple groove pulley 22, which is connected by drive belts 23 to an electric motor 24 located at the side of the housing and also on the top cover 4. For safety reasons, the multiple groove pulley 22 and the drive belts 23 are enclosed by a housing 25.

Located on the end of the drive shaft 18 inside the housing 5 is a hub disk 26 that is rotated by the drive shaft 18. On its side facing the housing door 10, the hub disk 26 has, coaxial to the first tool ring 15, a second tool ring 27 whose active surface works together with the grooving in the first tool ring 15. The mutual axial distance between the two tool rings 15 and 27 decreases from the inner edges of the tool rings 15 and 27 toward their outer edges, resulting in a chipping zone in the shape of a milling gap that tapers radially outward. In the region about the axis of rotation 20, the hub disk 26 is covered by a cover plate/adjusting disk 33.

The eccentric arrangement of the axis of rotation 20, and hence of the tool rings 15 and 27, is explained in detail with reference to FIG. 4, which shows a radial section through only the housing 5 of the disk mill 1. As can be seen in this view, the housing 5 has a circular shape with $M_1$ as the center point of the circle. In spiral-shaped housings, $M_1$ would represent the starting point of the spiral. The material outlet 34 can be seen to open tangentially from the housing 5 in the base region of the housing 5. For this purpose, the last section of the housing circumference is matched to the direction of the material outlet 34, into which it preferably transitions uniformly.

$M_1$ defines a first Cartesian coordinate system with primary axes $X_1$ and $Y_1$. The primary axis $X_1$ is parallel to the tangential material outlet 34 and the primary axis $Y_1$ is perpendicular thereto. The primary axes $X_1$ and $Y_1$ divide the chipping chamber 6, which is enclosed by the housing 5, into sectors I, II, III and IV, with the material outlet 34 in sector I and the remaining sectors following in the direction of rotation indicated by the arrow 35.

Figure 4:
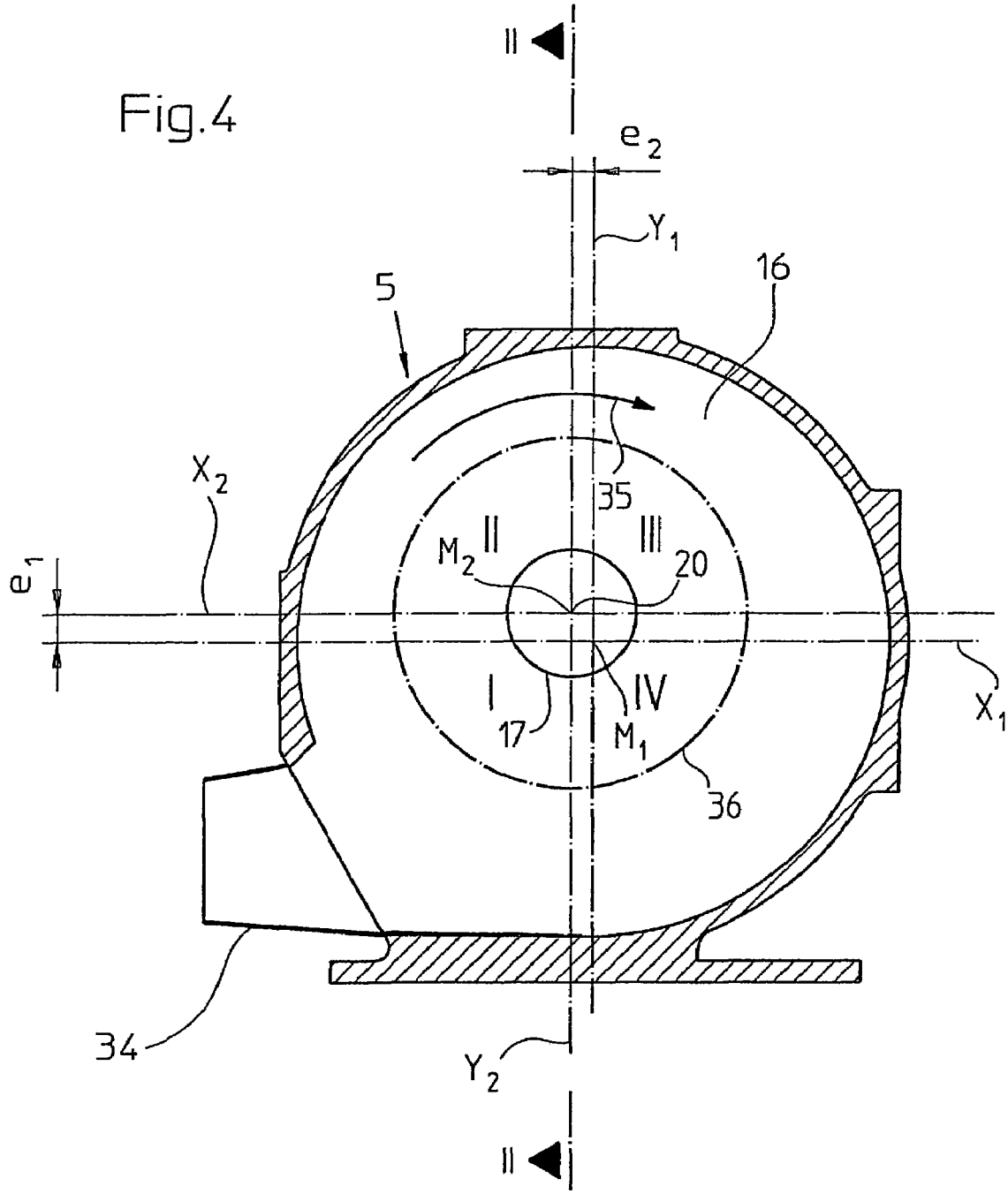
FIG. 4 is a radial sectional view through only a housing of the apparatus along the line IV—IV, which is shown in FIG. 3.

In turn, 17 designates the circular opening in the rear wall 16 of the housing 5, which is intended for the passage of the drive shaft 18, not shown in FIG. 4. Hence the center point $M_2$ of the opening 7 coincides with the axis of rotation 20, and determines the position of the first tool ring 15 and the second tool ring 27, whose outer surfaces of rotation is labeled 36. The circle center $M_2$ also defines a second Cartesian coordinate system with the axes $X_2$ and $Y_2$, which lie parallel to the primary axes of the first coordinate system.

The eccentric arrangement of the axis of rotation 20, and hence the tool rings 15 and 27, in the housing 5 results from the deviation $e_1$ of the axes $X_1$ and $X_2$ and the deviation $e_2$ of the axes $Y_1$ and $Y_2$ from one another. The eccentricity has the result that the smallest distance between the circumference of the housing 5 and the chipping tools 15 and 27 lies on a radial projection from $M_1$ through $M_2$. The zone with the greatest distance is diametrically opposite thereto.

In this way, the housing front wall 8 and housing rear wall 16, together with the housing circumference and the tool rings 15 and 27, form a channel that has its smallest distance to the housing circumference, and thus the smallest cross-sectional area, in sector II. The cross-sectional area of the channel, and thus its spatial volume, increases uniformly in the direction of rotation 35, and thus in sectors III and IV toward the material outlet 34. This achieves the result that the chipped material accumulating toward the material outlet 34 is provided with an essentially uniformly increasing volume so that the material density in the exit channel remains constant or even decreases, thus counteracting clogging in the material flow.

The invention is explained above on the basis of an example embodiment shown in the drawings. The example embodiment relates to a disk mill and represents just one way to implement the invention. The statements made herein apply equally well to other chipping apparatuses such as refiner mills, impact disk mills, dual flow mills, pinned disk mills, pin beater mills and universal mills, for example.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A chipping apparatus comprising:

a housing; and a chipping system for chipping material, the chipping system being located within the housing and rotating in a predefined direction about an axis of rotation, the chipping system further including a first chipping tool and a second chipping tool moving relative to one another during rotation thereof and thereby forming a circular chipping zone through which air flows, wherein the material is introduced into the housing in an axial direction, with respect to the axis of rotation, and is then supplied in a radial direction, with respect to the axis of rotation, to the first and second chipping tools, the material being drawn out of the housing as chipped material tangentially through an outlet after chipping, wherein the housing is defined by a first coordinate system having primary axes $X_1$ and $Y_1$, which intersect at right angles in a center point $M_1$ of the housing, the primary axis $Y_1$ being arranged substantially perpendicular to a tangential outlet direction so that the housing is divided by the primary axes $X_1$ and $Y_1$ into sectors I, II, III and IV in the direction of rotation, where the material outlet is arranged in sector I, wherein the axis of rotation of the chipping system is arranged eccentrically, with respect to the center point $M_1$ of the housing, in the region of sectors I or II of the housing, and wherein the housing has a circular cross-section, with M1 being a center point of the circular cross-section.

2. The chipping apparatus according to claim 1, wherein the axis of rotation is arranged in a region about an angle bisector of sector II of ±15°.

3. The chipping apparatus according to claim 1, wherein an eccentricity of the axis $X_1$ is greater than an eccentricity of the axis $Y_1$ with respect to the center point $M_1$.

4. The chipping apparatus according to claim 1, wherein a distance of the axis of rotation from the center point $M_1$ is less than one fifth of a distance from the center point $M_1$ to the circumference of the housing.

5. The chipping apparatus according to claim 1, wherein the chipping tools define a circular or ring-shaped chipping zone whose shortest distance to a circumference of the housing is at least one fifth of a greatest distance to the circumference of the housing, preferably approximately half as large as the greatest distance.

6. The chipping apparatus according to claim 1, wherein the housing is manufactured as a single piece and a transition between an outer circumferential surface and a front wall or a rear wall is rounded with a radius of 15 mm to 30 mm, preferably 25 mm.

7. The chipping apparatus according to claim 1, wherein the axis of rotation of the chipping system is arranged eccentrically in sector II of the housing.

8. The chipping apparatus according to claim 1, wherein the axis of rotation is arranged in a region about an angle bisector of sector II of ±10°.

9. A chipping apparatus comprising:

a housing; and a chipping system for chipping material, the chipping system being located within the housing and rotating in a predefined direction about an axis of rotation, the chipping system further including a first chipping tool and a second chipping tool moving relative to one another during rotation thereof and thereby forming a circular chipping zone through which air flows, wherein the material is introduced into the housing in an axial direction, with respect to the axis of rotation, and is then supplied in a radial direction, with respect to the axis of rotation, to the first and second chipping tools, the material being drawn out of the housing as chipped material tangentially through an outlet after chipping, wherein the housing is defined by a first coordinate system having primary axes $X_1$ and $Y_1$, which intersect at right angles in a center point $M_1$ of the housing, the primary axis $Y_1$ being arranged substantially perpendicular to a tangential outlet direction so that the housing is divided by the primary axes $X_1$ and $Y_1$ into sectors I, II, III and IV in the direction of rotation, where the material outlet is arranged in sector I, wherein the axis of rotation of the chipping system is arranged eccentrically, with respect to the center point $M_1$ of the housing, in the region of sectors I or II of the housing, and wherein the housing has a spiral-shaped cross-section, with $M_1$ being a starting point of the spiral.

10. A chipping apparatus, comprising:

a housing having a material inlet and a material outlet, and an arcuate housing wall defining a chipping chamber therein, said arcuate housing wall having a radius of curvature measured from a central axis of said housing which is substantially constant over at least one-half of a circumference of said arcuate housing walk; and a chipping tool located within said housing, said chipping tool being rotatable about an axis of rotation which is displaced from the central axis of said housing, wherein a radius measured from the axis of rotation of the chipping tool to the arcuate housing wall increase, from a starting point on the arcuate housing wall, over at least one-half of the circumference of said arcuate housing wall in a direction towards the material outlet, and wherein a radius measured from the axis of rotation of the chipping tool to the arcuate housing wall is greater at an area of the arcuate housing wall that is formed by the material outlet than at the starting point, and wherein the axis of rotation of said chipping tool is displaced vertically and horizontally from the central axis of said housing.

11. The chipping apparatus of claim 10, wherein said material inlet is located on one side of said housing, and said material outlet is located in said arcuate housing wall.

12. The chipping apparatus of claim 10, wherein the radius of curvature of said arcuate housing wall is substantially constant over approximately three-quarters of the circumference of said arcuate housing wall.

13. The chipping apparatus of claim 10, wherein said arcuate housing wall has an inner side that forms a substantially circular outer periphery of the chipping chamber.

* * * * *